US010543941B2

(12) United States Patent
Lizari Illarramendi et al.

(10) Patent No.: US 10,543,941 B2
(45) Date of Patent: Jan. 28, 2020

(54) MACHINE AND METHOD FOR THE AUTOMATIC PREPARATION OF SUBSTANCES FOR INTRAVENOUS APPLICATION

(71) Applicant: KIRO GRIFOLS, S.L., Arrasate (Gipuzkoa) (ES)

(72) Inventors: Borja Lizari Illarramendi, Araico (ES); Naiara Telleria Garay, Arrasate-Mondragon (ES); Asier Lizarriturri Martiarena, Aretxabaleta (ES); Ana Belen Barrio Jimenez, Vitoria-Gasteiz (ES); Amaia Ilzarbe Andres, Donostia-San Sebastian (ES); Jose Ignacio Andres Pineda, Vitoria-Gasteiz (ES)

(73) Assignee: Kiro Grifols, S.L., Arrasate (Gipuzkoa) (ES)

( * ) Notice: Subject to any disclaimer, the term of this patent is extended or adjusted under 35 U.S.C. 154(b) by 862 days.

(21) Appl. No.: 15/132,613

(22) Filed: Apr. 19, 2016

(65) Prior Publication Data

US 2017/0008651 A1 Jan. 12, 2017
US 2017/0233113 A9 Aug. 17, 2017

(30) Foreign Application Priority Data

Jul. 8, 2015 (ES) ..... 201530986

(51) Int. Cl.
*B65B 3/00* (2006.01)
*B65B 3/04* (2006.01)
(Continued)

(52) U.S. Cl.
CPC ..... *B65B 3/003* (2013.01); *B65B 3/04* (2013.01); *B65B 7/28* (2013.01); *B65B 39/12* (2013.01); *B65B 43/54* (2013.01)

(58) Field of Classification Search
CPC ..... B65B 3/003; B65B 7/28; B65B 7/2828; B65B 43/54
(Continued)

(56) References Cited

U.S. PATENT DOCUMENTS 10,181,186 B2 * 1/2019 Kriheli ..... B65B 55/02
2012/0241042 A1 9/2012 Strangis
(Continued)

FOREIGN PATENT DOCUMENTS

EP 1726963 A2 11/2006
EP 2457550 A1 5/2012
(Continued)

OTHER PUBLICATIONS

Extended European Search Report dated Nov. 30, 2016 in corresponding EP Application No. 16165492.6.
(Continued)

*Primary Examiner* — Chelsea E Stinson
(74) *Attorney, Agent, or Firm* — Knobbe, Martens, Olson & Bear, LLP

(57) ABSTRACT

A machine and a method are for the automatic preparation of substances for intravenous application. The machine includes a container receiving zone which defines a matrix of individual positions for initial and final containers, and a number of actuators for transferring substances from initial container to final container. Each of the actuators is positioned beneath the zone for receiving initial and final containers, each of the actuators is able to move relatively, independently of the rest of the actuators, and each of the actuators is suitable for receiving and operating injectors with different volumes and degrees of precision in order to remove substances from initial containers and insert them into final containers.

8 Claims, 17 Drawing Sheets

(51) Int. Cl.
*B65B 7/28* (2006.01)
*B65B 39/12* (2006.01)
*B65B 43/54* (2006.01)

(58) Field of Classification Search
USPC ..... 53/467, 468
See application file for complete search history.

(56) References Cited

U.S. PATENT DOCUMENTS

| | | | | |
|---|---|---|---|---|
| 2014/0087370 | A1 | 3/2014 | Maeshima | |
| 2015/0175398 | A1* | 6/2015 | Christensen | B67B 3/20 53/490 |
| 2015/0335532 | A1* | 11/2015 | Lizari Illarramendi | A61J 3/002 141/1 |
| 2016/0200462 | A1* | 7/2016 | Kriheli | B65B 55/02 700/214 |

FOREIGN PATENT DOCUMENTS

| | | | |
|---|---|---|---|
| ES | 2551809 | A1 | 11/2015 |
| WO | 98/33705 | A1 | 8/1998 |
| WO | 2015/029018 | A1 | 3/2015 |

OTHER PUBLICATIONS

Search Report dated Feb. 22, 2016 in corresponding ES application No. 201530986.

* cited by examiner

MACHINE AND METHOD FOR THE AUTOMATIC PREPARATION OF SUBSTANCES FOR INTRAVENOUS APPLICATION

CROSS-REFERENCE TO RELATED APPLICATION

This application claims priority to Spanish Patent Application No. 201530986 filed on Jul. 8, 2015, the disclosure of which including the specification, the drawings, and the claims is hereby incorporated by reference in its entirety.

FIELD OF THE INVENTION

The present invention relates to a machine and a method for the automatic preparation of substances for intravenous application.

BACKGROUND OF THE INVENTION

Machines for preparing substances for intravenous application are routinely used in hospitals to produce intravenous substance mixtures for application to each patient specifically, to reconstitute said substance from powder and/or to transfer a substance from an initial container, such as a flask or syringe, to the final container, such as a bag or syringe, from which said substance is applied to a line made in the patient, or alternatively a syringe or another flask.

The machines for preparing mixtures for intravenous application known at present have the drawback of being large, somewhat unergonomic machines with an insufficient and unsatisfactory capacity/preparation speed. Examples of small machines are also known, but these have very low productivity.

In addition, none of the machines for preparing mixtures for intravenous application known in the prior art allows for the preparation of paediatric medicines, which require more precise measurement of the medicine to be prepared owing to the small volumes of substance mixtures used.

SUMMARY OF THE INVENTION

An object of the present invention is to disclose a machine with improved capacity and preparation speed compared with that currently known, the dimensions of which are substantially small and which in addition allows medicines to be prepared with greater precision for paediatric purposes. An additional object of the present invention is to disclose a method carried out by said machine which improves the speed of substance preparation compared with the methods known in the prior art.

More particularly, the present invention discloses a machine for the automatic preparation of substances for intravenous application which comprises:

- a container receiving zone which defines a two-dimensional matrix of individual positions for initial and final containers arranged on two horizontal guides perpendicular to each other;
- a plurality of actuators for transferring substances from initial containers to final containers, each of said actuators being positioned beneath said zone for receiving initial and final containers, each of said actuators being able to move relatively, independently of each other, along a horizontal guide parallel to one of said horizontal guides of said matrix, each of said actuators being suitable for receiving and operating injectors having different volumes and degrees of precision in order to remove substances from initial containers and insert them into final containers.

The machine according to the present invention has the initial containers and the final containers matrix-like arranged, and beneath said containers has the actuators responsible for removing and inserting the substances in said containers using injectors, preferably syringes, which may have different volumes and degrees of precision. This allows loading and unloading to be carried out with greater or lesser precision in batches using short linear movements from batch to batch, with no circular movements, and so high speed of movement with greater or lesser precision and a small size is made possible as the length of the movements has been reduced.

In addition and particularly advantageously, each of the actuators for transferring substances can independently move vertically and horizontally in respect to the rest of the actuators, in order to be able to prepare various final products simultaneously.

According to a first embodiment of the present invention, the actuators are capable of receiving injectors of different volumes, such as syringes having their respective piercing point or needle, and of carrying out the process of removing and inserting substances directly using said piercing point or needle on the respective initial containers and final containers. Throughout the description, a needle or piercing point shall be understood to be the tube that is typically made of metal and of small diameter, of which the free distal end is bevel-cut and the other end of which is provided with a bushing that is connected to the distal portion of the barrel of the syringe for the injection, insertion or removal of substances.

Optionally, if the initial container and/or the final container consists of a syringe, "Luer-Lock" type additive introduction points must be used so that said syringe as the initial and/or final container can contain the substance and the actuator syringe can also remove and insert substances directly using the piercing point or needle.

In addition and particularly advantageously, said machine also comprises automatic actuating means for removing, holding and inserting syringe-type injector caps.

According to a second embodiment of the present invention, the actuators are capable of receiving injectors of different volumes, such as syringes without a piercing point that have a respective adaptor for connection to/disconnection from the initial/final containers, which may for example be syringes with no piercing point closed by a stopper. In this case, the actuators comprise rotation actuating means for twisting and untwisting said stoppers arranged in the inlet/outlet ports of the respective syringe-type containers and, in addition the actuators also comprise rotation actuating means for connecting and disconnecting the respective connection/disconnection adaptors arranged in the inlet/outlet ports of the injector syringes to/from the inlet/outlet ports of the respective syringe-type containers.

An additional object of the present invention is to disclose a method for the automatic preparation of substances for intravenous application using a machine according to the present invention. Said method is characterised in that it comprises the following steps:

- loading at least one injector in at least one actuator for substance transfer;
- moving the actuator-injector assembly along its respective horizontal and vertical guide until said assembly is positioned beneath an initial container;

removing substance from said initial container using said injector actuated by said actuator;

moving said actuator-injector assembly along its respective horizontal and vertical guide until said assembly is positioned beneath a final container;

inserting said substance from inside the injector into the final container by the action of said actuator.

According to a first preferred embodiment, the automatic actuating means for removing and inserting caps remove the cap from the injector.

According to a second preferred embodiment, the rotation actuating means untwist any stopper of the initial and/or final container. More preferably, the rotation actuating means of the injector actuator twist the stopper of the initial and/or final container.

Preferably, the rotation actuating means of the actuator twist and/or untwist the nozzle of the injector onto/off the nozzle of the initial and/or final container for connection and/or disconnection, respectively.

BRIEF DESCRIPTION OF THE DRAWINGS

To better understand the machine according to the present invention for the automatic preparation of substances for intravenous application, the accompanying drawings show an embodiment thereof as an explanatory but non-limiting example.

DETAILED DESCRIPTION OF THE PREFERRED EMBODIMENTS

Figure 1:
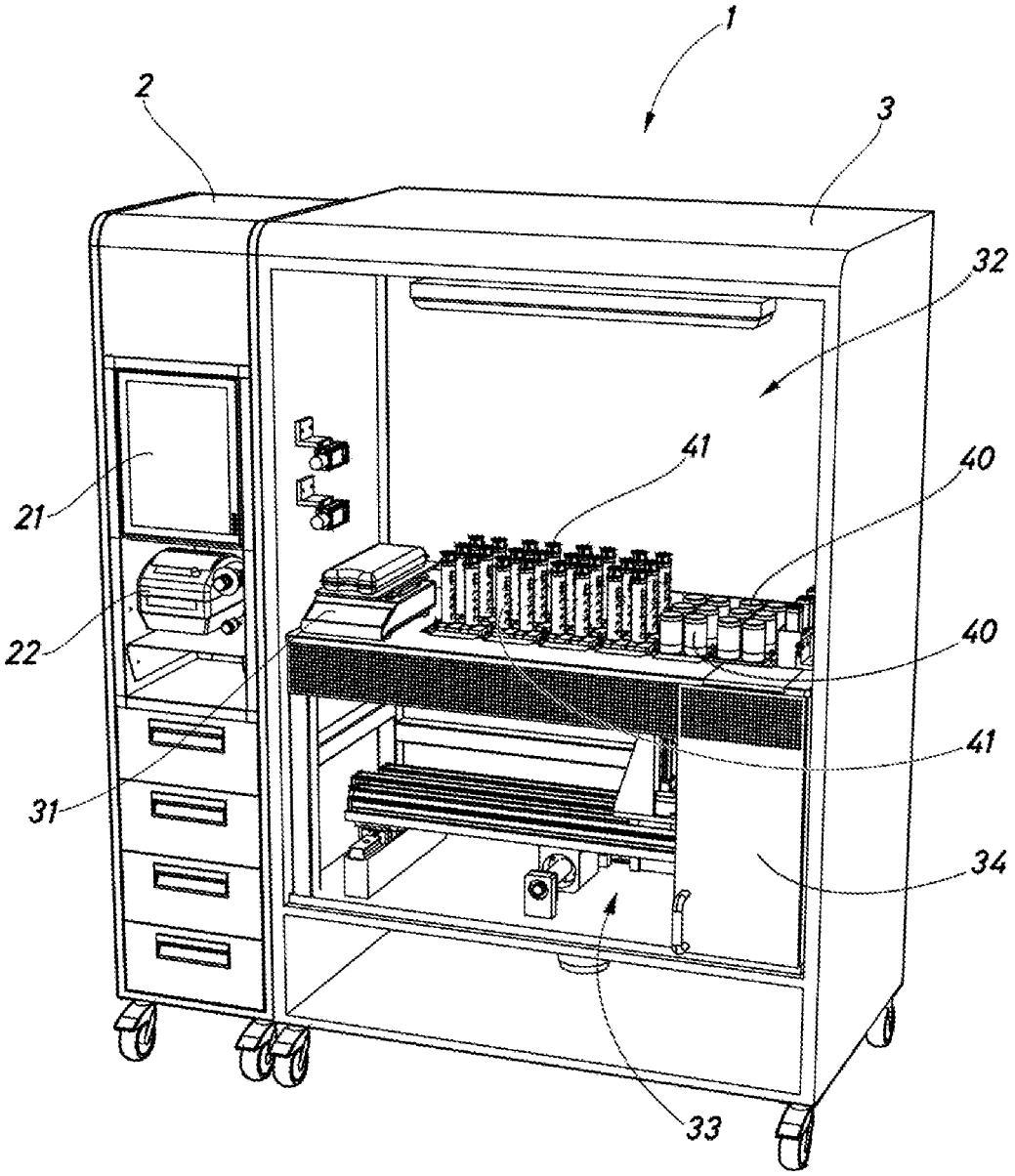
FIG. 1 is a perspective view of an embodiment of a machine according to the present invention for the automatic preparation of substances for intravenous application.

FIG. 1 shows an embodiment of a machine —1— according to the present invention for the automatic preparation of substances for intravenous application. Said machine —1— is made up of two modules:

a first module —2— which incorporates a portion known as the "traceability zone", and a second module —3— which consists of a horizontal laminar flow cabinet which incorporates, on one side, the other portion corresponding to said traceability zone and, on the other side, also incorporates the zone known as the "preparation zone".

The traceability zone is the zone where the user controls the loading and unloading of the material to be used, and comprises different devices for the control and traceability of all the types of initial and final containers that are involved in the automatic preparation of substances for intravenous application. Said devices, which are distributed between both modules (—2—, —3—), may comprise, among others, a touch screen —21—, a printer —22—, a set of scales —31—, different RFID or bar code readers (not shown) and different enabling and/or emergency switches (not shown). The features of each element will be explained in more detail below.

The preparation zone, which is located exclusively in the module —3— (horizontal laminar flow cabinet) of the machine —1—, is the zone where the initial and final containers are arranged and where products or substances are automatically metered from said initial containers to said final containers. Said preparation zone is made up of two distinct sub-zones:

(a) A first sub-zone —32— which comprises a preparation tray —4— (see FIG. 2) where the initial and final containers are arranged. In addition, said first sub-zone —32— may comprise additional devices corresponding to the traceability zone, such as the scales —31—, bar code readers or RFID readers, and also enabling or emergency stop switches of the machine (not shown);

(b) A second sub-zone —33— positioned beneath said first sub-zone —32— where the automated metering lines are arranged, which consist of automatic actuators, which are able to move vertically and horizontally along respective vertical and horizontal guides, for the removal of substances from initial containers and insertion thereof into final containers. The technical features of said actuators will be explained in more detail below.

As will be explained in more detail below, the metering carried out by the machine —1— according to the present invention takes place using syringes —5— which are operated by each actuator (—331—, —332—, —333—) of each metering line respectively. Accordingly, the machine —1— comprises in the second sub-zone —33— a front-access door —34— allowing access to the loading and unloading of the syringe —5— of its respective actuator.

In general, the syringes used in the present invention may be of the type that comprises a "Luer-Lock" distal nozzle. Said "Luer-Lock" nozzle, widely known in the prior art, particularly in the health sector, consists of a male screw-type connection which enables connection of elements such as a piercing point, or a female "Luer-Lock" adaptor, thus providing a secure and hermetic seal, avoiding leaks and direct contact risks. The locking system using "Luer-Lock" connections secures the needle or any adaptor so that it cannot move or be broken off the syringe. It should be noted in addition that, in the health sector, where a syringe has a distal end comprising a "Luer-Lock" connection, said "Luer-Lock" connection is normally known as the "male" connection, whereas at the point where said male "Luer-Lock" connection is coupled the "Luer-Lock" connection is known as the female connection, such as said port of a container, a needle or an adaptor.

The dimensions of the module —2— in the configuration of the machine shown in FIG. 1 may, for example, be 500 mm×1950 mm×450 mm (width×height×depth) and the dimensions of the module —3— (laminar flow cabinet) may be 1200 mm×1950 mm×720 mm (width×height×depth), these last dimensions possibly varying depending on the dimensions of the tray —4— (which depends on the number of final products to be prepared) and/or the number of substance metering lines.

Dimensions of the module —3— such as those above allow a tray —4— to be arranged defining a matrix of 12×3 elements, or in other words, twelve elements per metering line, the first four of which, for example, starting at the right of the tray —4— are initial containers —40— and the next eight elements are final containers —41—. Different combinations of initial and final containers are possible depending on the requirements of each case. Similarly, the tray —4— may have smaller or larger dimensions.

The horizontal laminar flow cabinet is characterised by having the following common systems, which it should include:

Fan motor system (not shown);

HEPA (high-efficiency particle arresting) air filters: said high-efficiency filters are known in the prior art and avoid the propagation of bacteria and viruses through the air; they are therefore very important for preventing infections.

First Embodiment of the Preparation Zone

Figure 2:
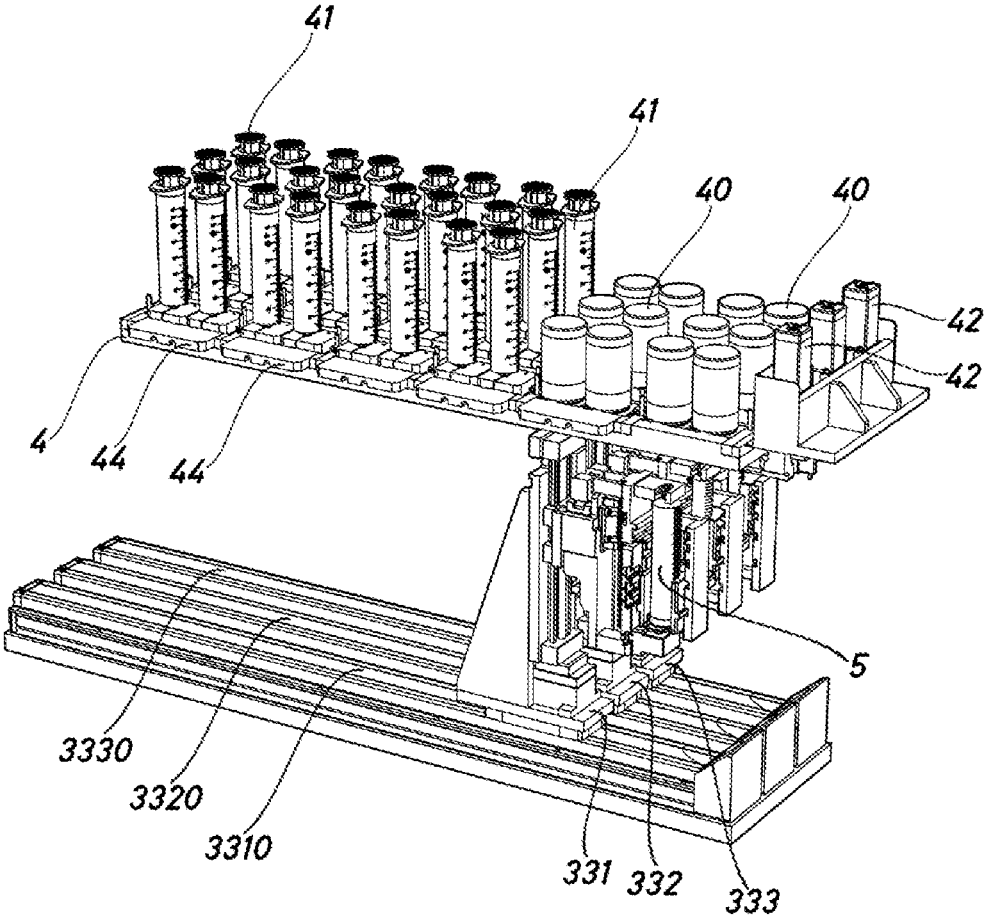
FIG. 2 is a perspective view of the preparation zone of the machine where the different elements, initial and final containers and substance removal and insertion devices according to a first embodiment are located.

FIG. 2 shows a first embodiment of the preparation zone of the machine according to the present invention. Some elements and/or devices of the machine —1— have been omitted in order to more clearly show the arrangement of the different containers on the tray —4— as well as the arrangement and interaction of the actuators of the different substance metering lines. In this embodiment, as will be explained in more detail below, the metering is carried out using syringes —5— having a piercing point or needle operated by each actuator (—331—, —332—, —333—) of each metering line, respectively. As indicated above, the terms needle or piercing point shall be understood as the tube that is typically made of metal and of small diameter, of which the free distal end is bevel-cut and the other end of which is provided with a bushing that is connected to the distal portion of the barrel of the syringe for the injection, insertion or removal of substances.

According to this first embodiment, the tray —4— comprises a plurality of support elements —44— for receiving any type of container, such as flasks, syringes or bags. However, although the standard volume of a bag-type container could occupy all the receiving space of one element —44—, other types of container, such as a flask or a syringe, could occupy half the space of an element —44—. Consequently, a support element —44— in the tray —4— could be used to house at least two flasks —40— or two syringes —41—, allowing the storage capacity of said tray —4— to be doubled, as illustrated in FIG. 2. In the embodiment of FIG. 2, the tray —4— defines a matrix of 6×3 support elements —44—. However, when syringes —41— are used as the final containers and flasks —40— as the initial containers, the matrix of 6×3 elements —44— is transformed into a matrix that defines 12×3 recesses for containers. In this case, starting at the right of the tray —4—, for each metering line firstly there are four flasks —40— as initial containers and then eight syringes —41— as final containers, although other configurations are possible.

Alternatively, starting at the right of the tray —4—, for each metering line four flasks —40— could first be arranged as initial containers and then four infusion bags as final containers.

In addition, depending on the type of container to be housed in each of the support elements —44— of the tray —4—, a specific adaptor could be used for each type of container, and the elements —44— will, in turn, be capable of universally housing any type of container having its respective adaptor. The correct position of the adaptors on the tray —4— can be ensured by foolproof systems to minimise and avoid connection errors. Thus, a flask adaptor, a syringe adaptor or a bag adaptor can be placed in each support element —44— without the need to fit any additional component, allowing the syringe —5— to always maintain the same horizontal position of the injection point in each of said recesses —44—. Thus, the vertical movement distance of the respective actuator (—331—, —332—, —333—) will be the same for any type of container. In addition, high flexibility is obtained when making preparations as more or fewer flasks, more or fewer syringes or more or fewer bags can be loaded depending on the requirements in each case.

With regard to the container adaptors, said adaptors can take the form of a wedge (not shown) so as to centre the container at the same point of the element —44—. In addition, by using ball positioners arranged in the elements —44— (not shown) in the tray —4—, the adaptors can always be fitted in the same position in each support element —44—. Moreover, the elements —44— may have an automatic or manual system for retaining and releasing the adaptors, ensuring that the adaptor does not move vertically when the syringe —5— punctures the port of the container.

In the case of syringe adaptors or other types of container such as infusers or cassettes, the holding will take place at said connection point, which may consist of a female-female "Luer-Lock" connector. Said holding will therefore be valid for any type of syringe, provided it has a "Luer-Lock" connection.

In addition, each container adaptor may carry an RFID label to identify at all times the type of substance or medicine contained in the container which is fitted in said adaptor. The substance metering process can thus be traced and controlled for each operation.

Each of the actuators (—331—, —332—, —333—) may also comprise an RFID antenna to check, prior to puncturing, that the medicine or substance in the container placed in the recess —44— is the correct one.

Alternatively, bearing in mind that the use of infusion bags as initial or final containers could result in too much space being occupied in the tray —4— and that, on occasion, said bags can be very unstable, it would be possible for said bags to be hung from hooks arranged in said first sub-zone —32—.

In addition, in this first embodiment, the metering takes place through the use of syringes —5— having piercing points, said syringes being operated respectively by an actuator (—331—, —332—, —333—) arranged on a respective horizontal guide (—3310—, —3320—, —3330—) each defining a metering line. Said actuators (—331—, —332—, —333—) can move independently along the respective horizontal guide (—3310—, —3320—, —3330—). In principle, for each metering operation, the movements of each actuator (—331—, —332—, —333—) will be from right (where the initial containers —40— are located) to left (where the final containers —41— are located).

Furthermore, in this first embodiment, there is one mechanism —42— for holding the caps of the needles of the syringes —5— for each metering line. Said mechanism —42— for holding the caps of the needles of the syringes —5— is arranged to the right of the initial containers —40—.

Figure 3:
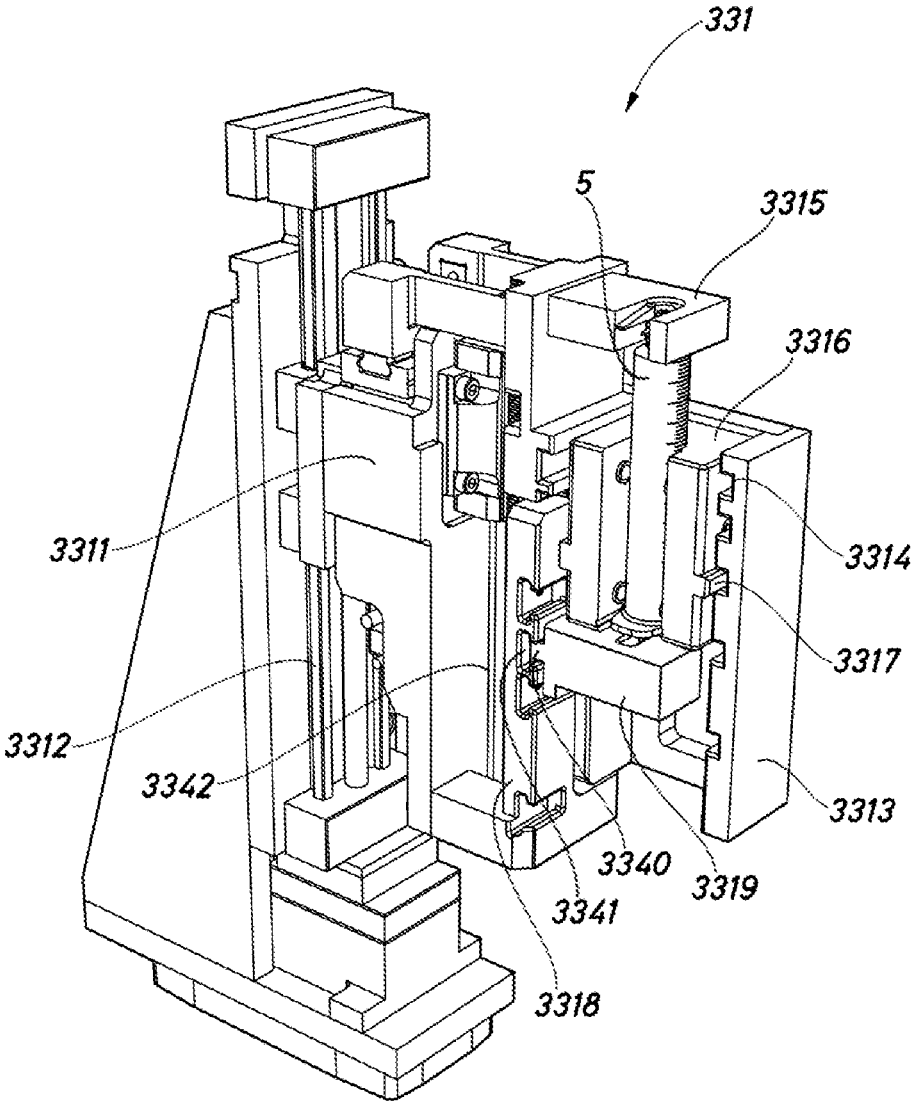
FIG. 3 is a perspective view of the syringe actuator for the removal and insertion of substances of FIG. 2 according to a first embodiment.

FIG. 3 is a perspective view of one of the syringe actuators, in this case the actuator —331—, according to said first embodiment. Said actuator comprises a carriage —3311— which can slide vertically along a vertical guide —3312—. On one side, said carriage —3311— comprises a rigidly connected holder —3313— of the syringe barrel and a rigidly connected holder —3315— of the syringe nozzle. The holder —3313— of the syringe barrel comprises a plurality of grooves —3314— suitable for receiving different types of adaptors for different types of syringes. In fact, the syringe —5— that is loaded in the actuator —331— to remove and insert substances is held by a syringe adaptor —3316—. Said syringe adaptor —3316— comprises an inner recess suitable for housing the barrel of a syringe —5— and further comprises on its outer surface at least one projection —3317— suitable for being inserted into one of the grooves —3314— in the holder —3313— of the actuator —331—. Different types of syringe adaptors can be used depending on the size and volume of the syringe. The plurality of grooves —3314— in the holder —3313— also allows for different positions of the syringe —5— depending on requirements. In addition, the flange of the plunger of the syringe —5— is also held by a flange adaptor —3319— which allows different types of plungers and flanges to be arranged in the actuator —331—. Different types of adaptors for plunger flanges may be used depending on the size and volume of the syringe to be used. The flange adaptor —3319— comprises on its outer surface at least one projection —3340— suitable for being inserted into one of the grooves —3341— in a plunger flange actuator —3318— rigidly connected to said carriage —3311— of the syringe actuator. Said plunger flange actuator —3318— can slide vertically along a vertical guide —3342—, allowing the plunger of the syringe to be actuated during substance removal and insertion operations.

FIGS. 4 to 7 illustrate different steps of a process for removing substances from an initial container —40— and inserting them into a final container —41— by means of one of the actuators (—331—, —332—, —333—) according to a first embodiment.

Figure 4:
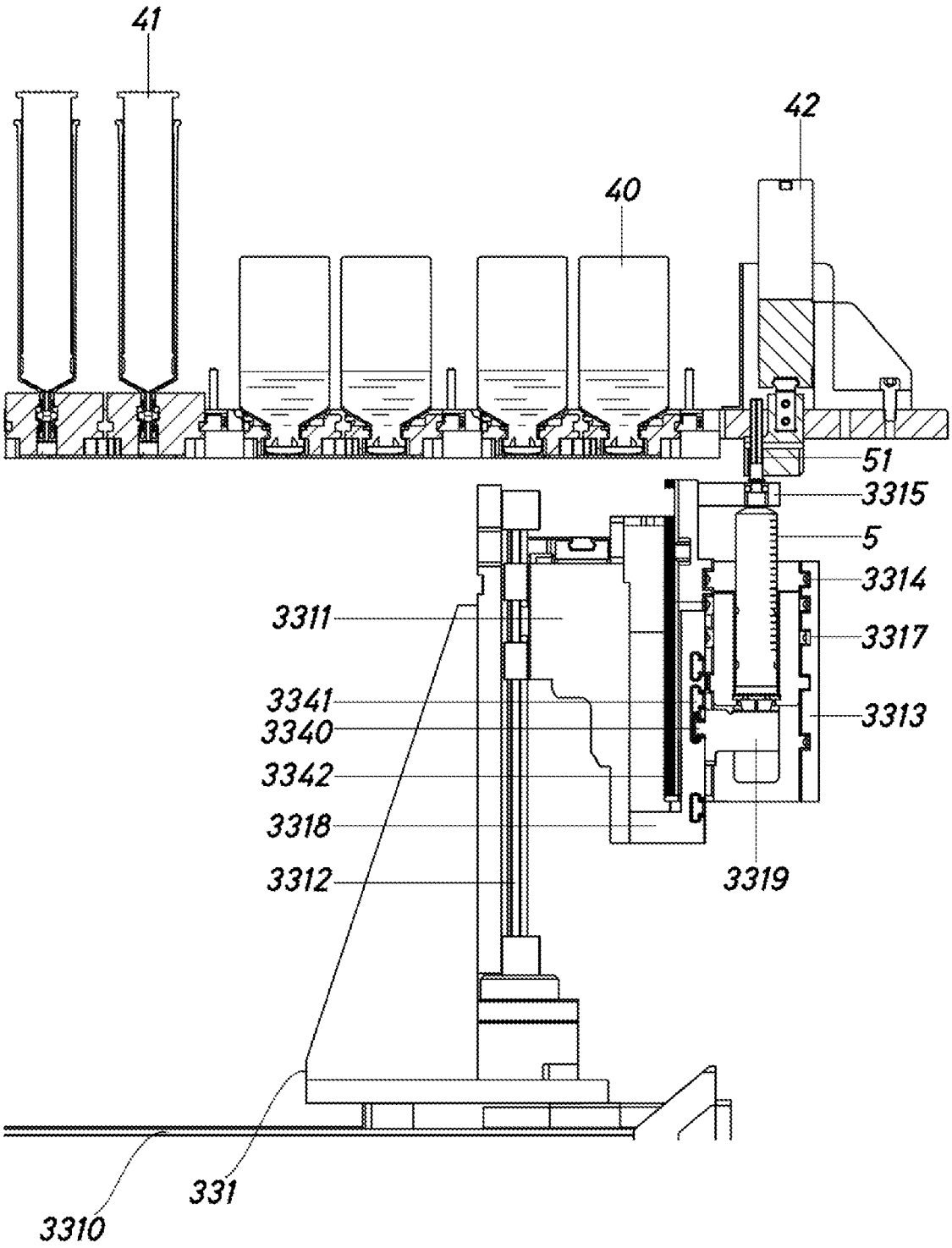
FIGS. 4 to 7 are different views in side elevation that show various steps of a method for removing and inserting substances from an initial container to a final container using an actuator according to a first embodiment like the one in FIG. 3.

In FIG. 4, the actuator —331— is placed in such a way that the holder —3313— of the syringe —5— is positioned beneath the mechanism —42— for holding the caps of the needles of the syringes —5—. By the action of the carriage —3311— along the vertical guide —3312—, the cap —51— of the syringe —5— is held by a clamp (not shown) of the mechanism —42— which retains said cap —51—.

Figure 5:
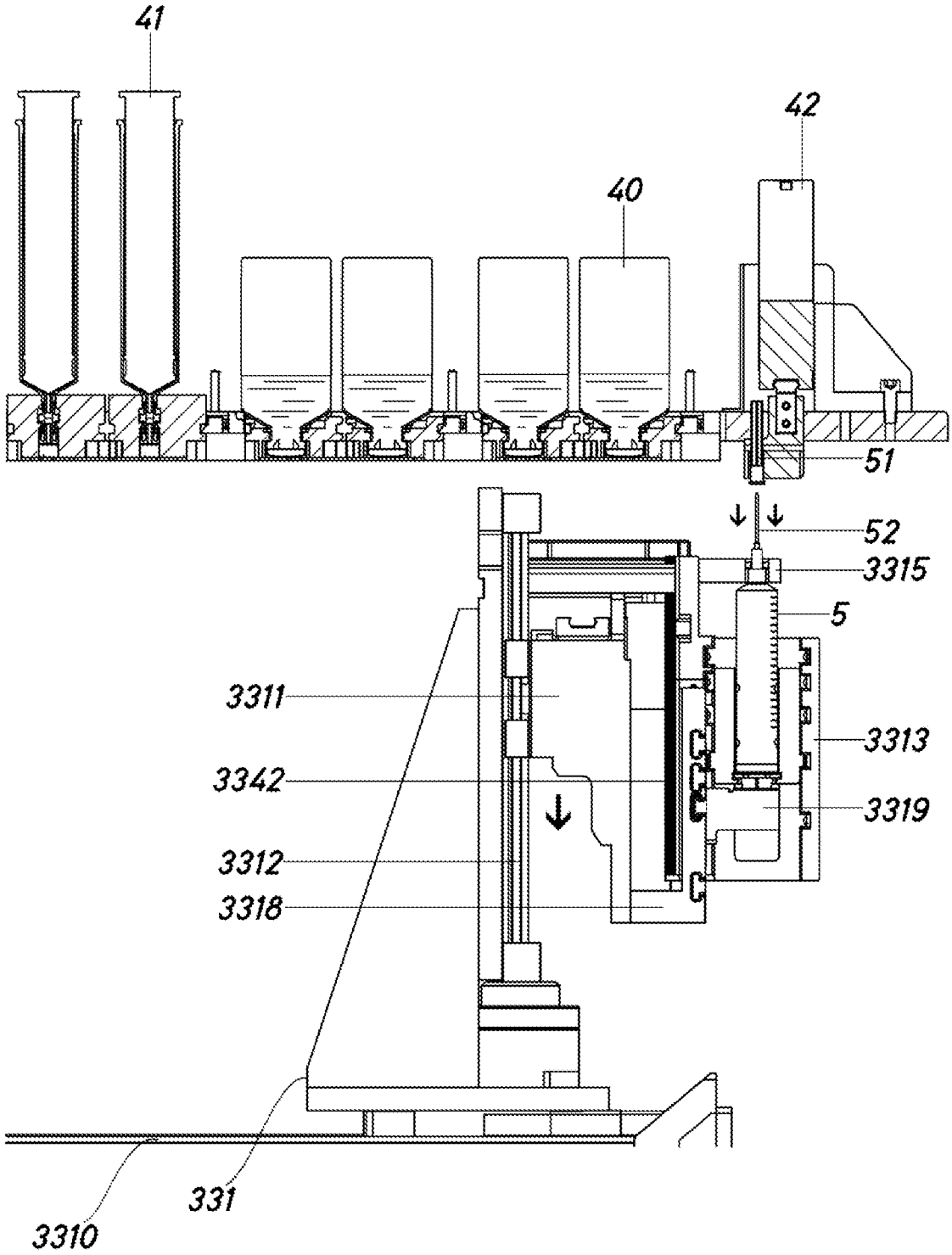

In FIG. 5, while said clamp of the mechanism —42— retains said cap —51—, the carriage —3311— slides vertically downwards along the vertical guide —3312— so as to release the piercing point —52— of the syringe —5— from the cap —51—.

Figure 6:
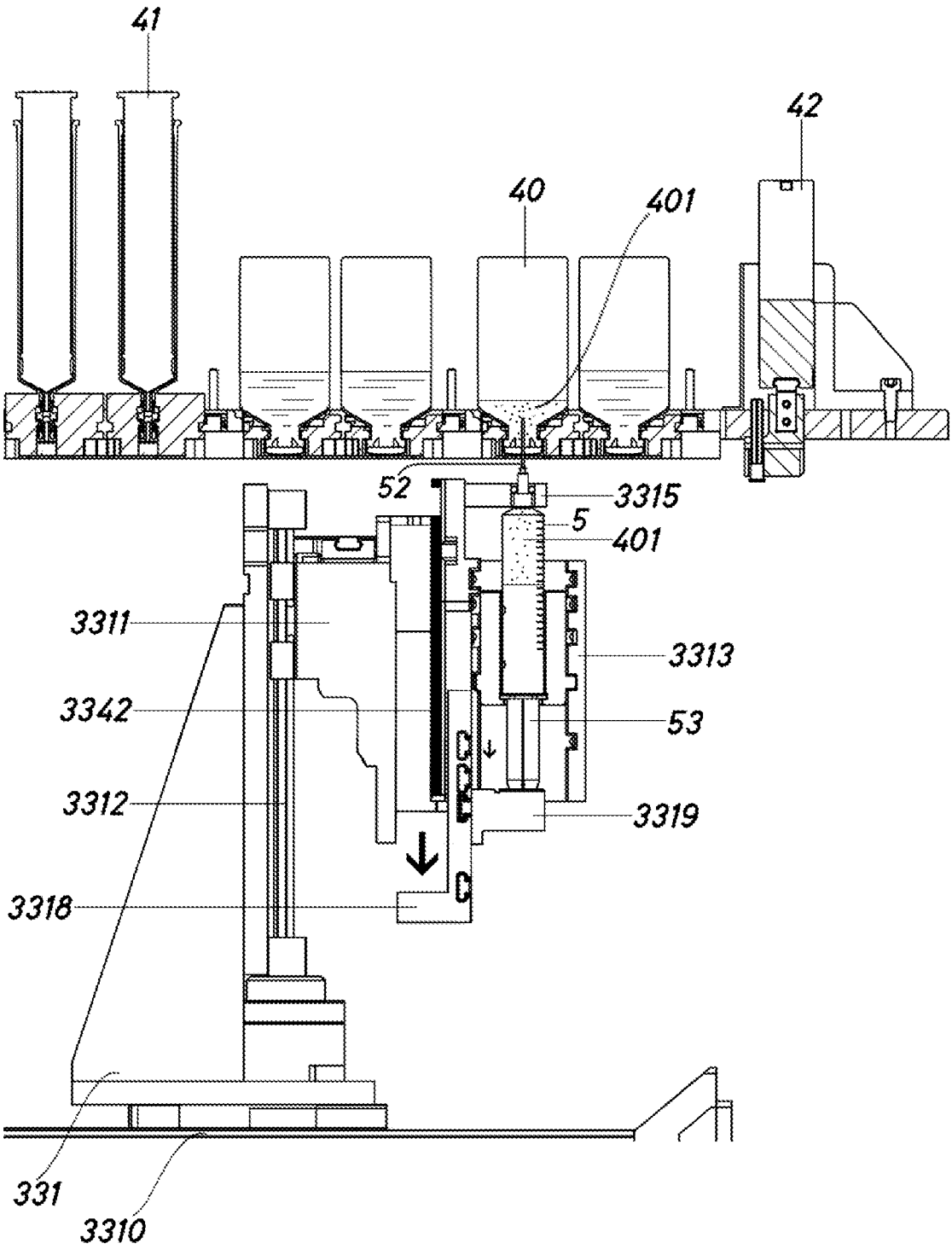

In FIG. 6, the actuator —331— has moved along the horizontal guide —3310— so as to position the syringe —5— beneath an initial container (in this case a flask —40— containing a particular substance —401—). By the vertical movement of the carriage —3311— along the vertical guide —3312—, the piercing point or needle —52— of the syringe —5— has been inserted inside the flask —40— through the inlet/outlet port thereof. Next, the plunger actuator —3318— slides downwards along the vertical guide —3342—, sliding the plunger —53— towards the outside of the syringe —5— so as to remove the substance —401— from inside the flask —40— and introduce said substance into the barrel of the syringe —5—.

Figure 7:
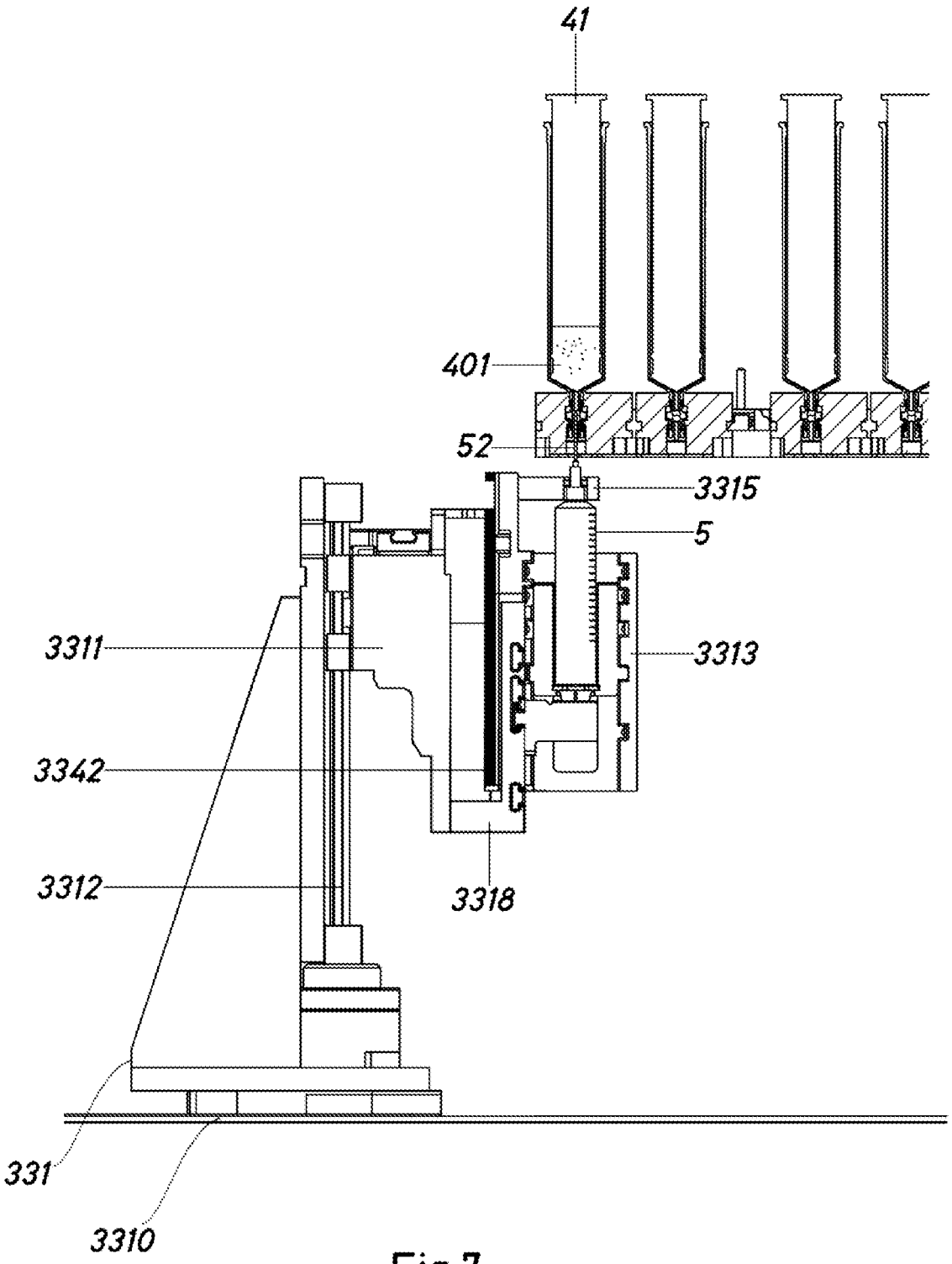

In FIG. 7, the actuator —331— has moved along the horizontal guide —3310— so as to position the syringe —5—, containing some of the substance —401— therein, beneath a final container (in this case a syringe —41—). By moving the carriage —3311— along the vertical guide —3312—, the piercing point —52— of the syringe —5— has been inserted into the syringe through a connection point connected to the inlet/outlet port of said syringe —41—. Next the plunger actuator —3318— slides upwards along the vertical guide —3342—, sliding the plunger —53— inside the syringe —5— so as to insert the substance —401— from inside the syringe —5— into the syringe —41— (final container).

Each actuator (—331—, —332, —333—) according to this first embodiment can perform the operations as described with reference to FIGS. 4 to 7 as many times as necessary depending the requirements at the time.

Once a substance transfer operation has taken place between an initial container and a final container, and whenever the syringe —5— needs to be changed, the actuator —331— is placed so as to position the holder —3313— of the syringe —5— beneath the mechanism —42— for holding the caps of the needles of the syringes —5—. By moving the carriage —3311— along the vertical guide —3312—, the piercing point —52— of the syringe —5— is inserted inside the cap —51—, which is held by a clamp (not shown) of the mechanism —42— which retains said cap —51—. Once the piercing point —52— of the syringe —5— has been inserted inside the cap —51—, the clamp of the mechanism —42— releases the cap —51— and by moving the carriage —3311— along the vertical guide —3312—, the assembly (syringe —5—, cap —51—) moves back downwards allowing an operator to subsequently unload the syringe —5—, having its piercing point —52— covered by the corresponding cap —51—, through the front access door —34— of the machine —1— (see FIG. 1).

In addition, the actuators (—331—, —332—, —333—) may have a visual control camera (not shown) which allows the type of syringe —5— loaded in said actuators (—331—, —332—, —333—) to be checked at any time. Said camera can also check whether substances have been correctly removed and/or inserted between initial containers and final containers and can even detect whether air has been removed at any time.

Second Embodiment of the Preparation Zone

Figure 8:
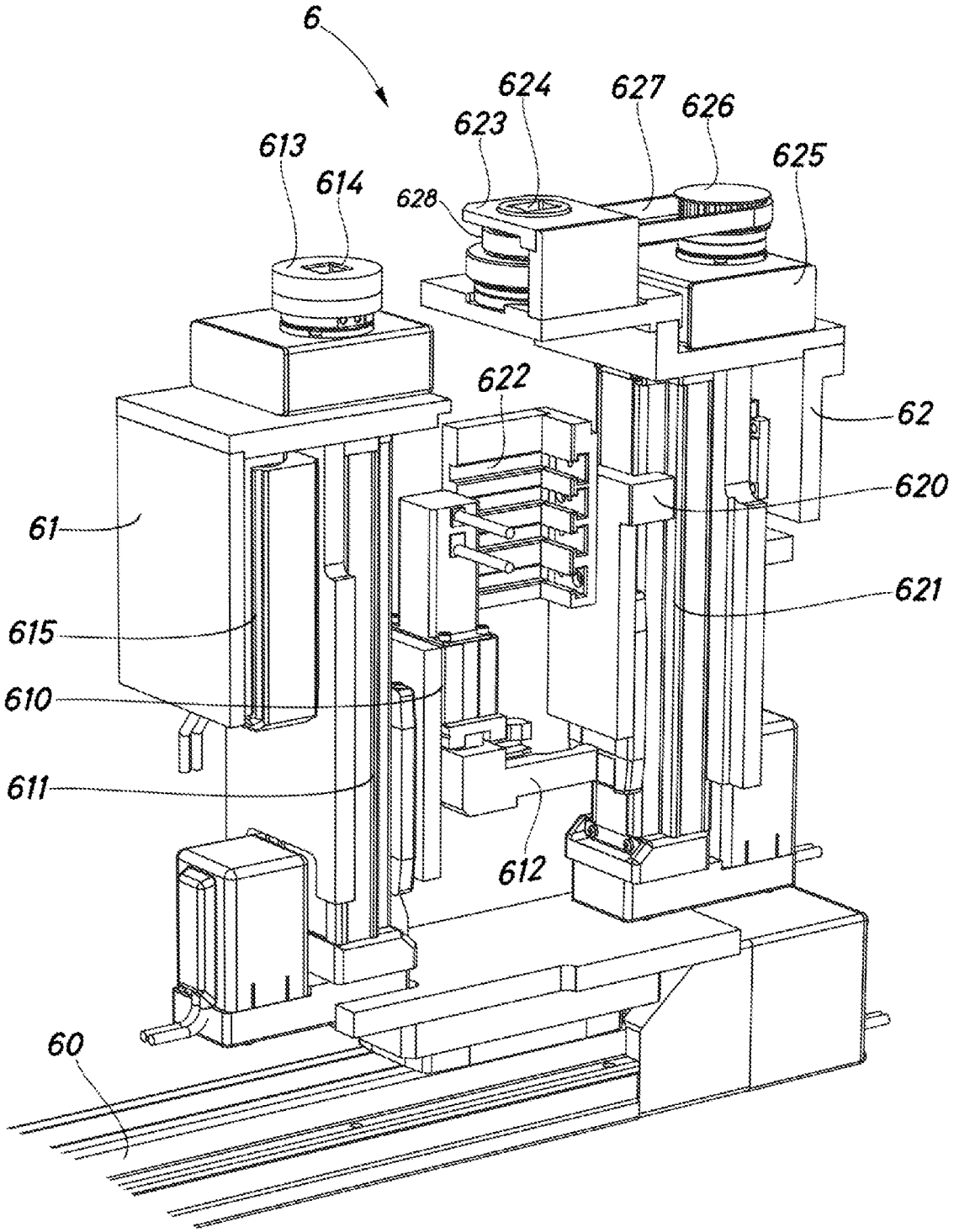
FIG. 8 is a perspective view of a second embodiment of a syringe actuator for the removal and insertion of substances.

FIG. 8 shows a second embodiment of the preparation zone of the machine —1— according to the present invention, and in particular a second embodiment of a syringe actuator —6— according to the present invention. Some elements and/or devices have been omitted from the machine —1— to more clearly show the structure of the actuator —6— arranged in a substance metering line along a horizontal guide —60—.

Figure 9:
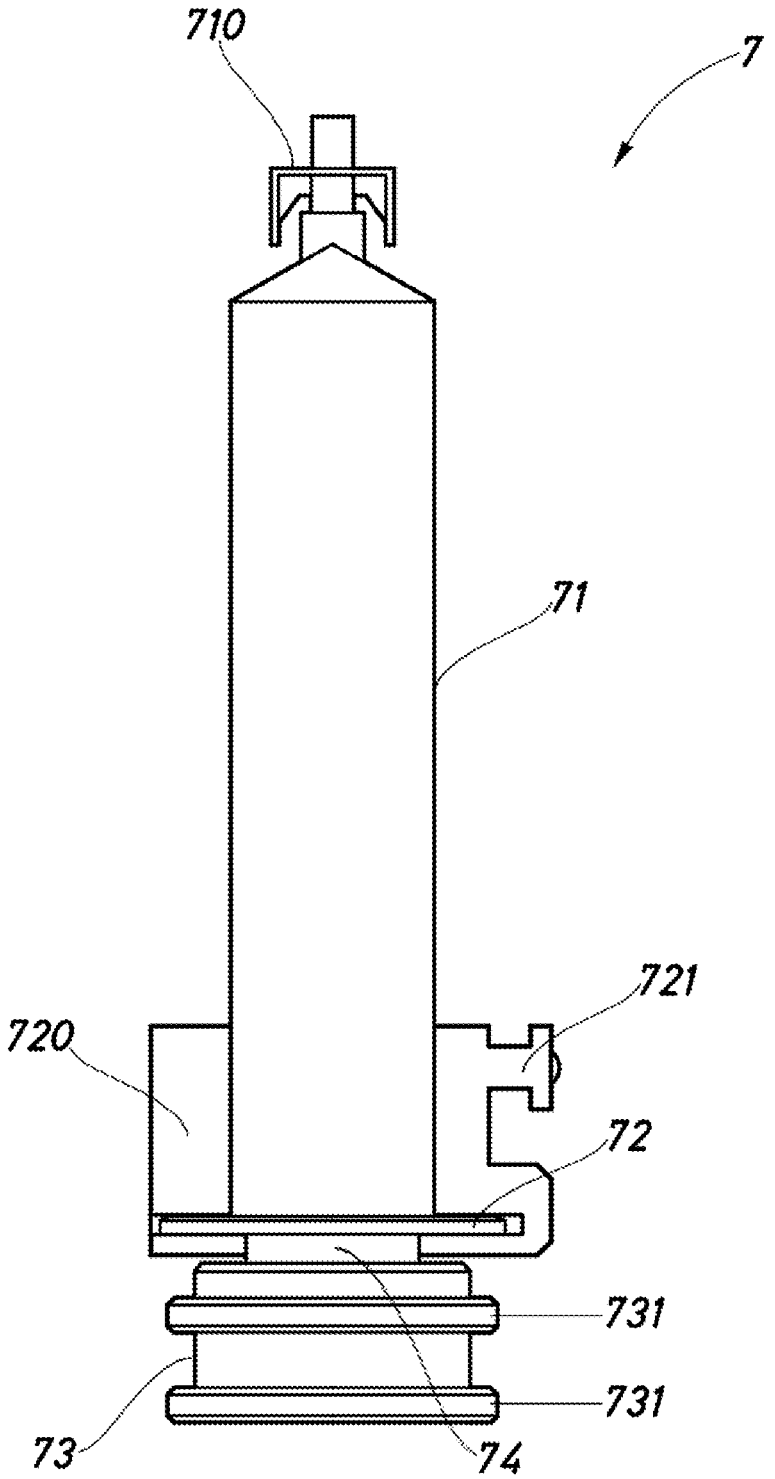
FIG. 9 is a view in side elevation of a syringe for use by an actuator according to the second embodiment of FIG. 8.

In this second embodiment, as will be explained in more detail below, metering takes place using syringes —7— having no piercing point, operated by a respective actuator —6— along a horizontal guide —60—. The barrel —71— of each syringe —7— comprises a female-female "Luer-Lock" adaptor —710— arranged on its respective inlet/outlet nozzle, as shown in FIG. 9, for direct connection to/disconnection from the male "Luer-Lock" nozzles of the initial and final containers. In addition, according to this second embodiment, the initial containers may be flasks, infusion bags or syringes having their respective male "Luer-Lock" inlet/outlet nozzles so as to allow them to be coupled to said female "Luer-Lock" adaptor —710—. The inlet/outlet nozzles of said initial and final containers are initially closed by a respective stopper to promote asepsis.

Each actuator —6— comprises, on one side, an actuator —61— for twisting and untwisting the stoppers of the initial and final containers and, on the other side, an actuator —62— for connecting and disconnecting the respective nozzles of the syringes —7— to/from the respective initial and final containers and subsequently to insert and/or remove substances between the initial and final containers.

The actuator —61— comprises a seating component —613— provided with a groove —614— for receiving stoppers of the initial and final containers. Said seating component —613— can rotate in order to twist and untwist said stoppers, and can move vertically along a vertical guide —615—. In addition, said actuator —61— comprises a carriage —610— that can slide vertically along a vertical guide —611— which comprises rigidly connected clamps —612— for actuating the plunger —74— of the syringe —7—.

On the other hand, the actuator —62— is made up of a rotary actuator —623— for adaptors —710—, which comprises a first central guide —628— through which passes a through-hole —624— for receiving the distal portion of the syringe —7— having its corresponding adaptor —710—. Said first central guide —628— can rotate by means of the action of a second guide —626— actuated by a motor —625—, said first guide —628— and second guide —626— being connected by a transmission belt —627—. The assembly (actuator —623— and motor —625—) together with its respective guides (first central guide —628— and second guide —626—) can move vertically along a vertical guide —629—.

Said actuator —62— also comprises a syringe barrel holder —620— that can move vertically along a vertical guide —621—. Said syringe barrel holder —620— comprises a plurality of grooves —622— suitable for receiving different types of adaptor —720— for different types of syringe. In reality, the syringe —7— which is loaded in the holder —620— to remove and insert substances is held by a syringe adaptor —720—, as shown in FIG. 9. Said syringe adaptor —720— comprises an inner recess suitable for housing the barrel of a syringe —7— and also comprises on its outer surface at least one projection —721— suitable for being inserted into one of the grooves —622— in the holder —620— of the actuator —62—. Different types of syringe adaptor can be used depending on the size and volume of the syringe to be used. The plurality of grooves —622— in the holder —620— also allows for different positions of the syringe —7— depending on requirements. In addition, the flange of the plunger —74— of the syringe —7— is also held by a flange adaptor —73—, which allows different types of plungers and flanges to be arranged in the actuators. Different types of plunger flange adaptors can be used depending on the size and volume of the syringe to be used. The flange adaptor —73— also comprises on its outer surface at least one projection —731—, which is used as a grip for the actuation clamps —612— of the syringe plunger by the actuator —61—.

FIGS. 10 to 17 illustrate different steps of a substance removal process from an initial container —80—, using one of the actuators —6— according to a second embodiment. The process of inserting the removed substance into a final container —81— is similar and analogous, using the same elements and actuators as set out below. According to this second embodiment, the arrangement of the initial and final containers is the same as in the first embodiment. In principle, for each metering operation, the movements of each actuator —6— will be from right (where the initial containers —80— are located) to left (where the final containers —81— are located).

Figure 10:
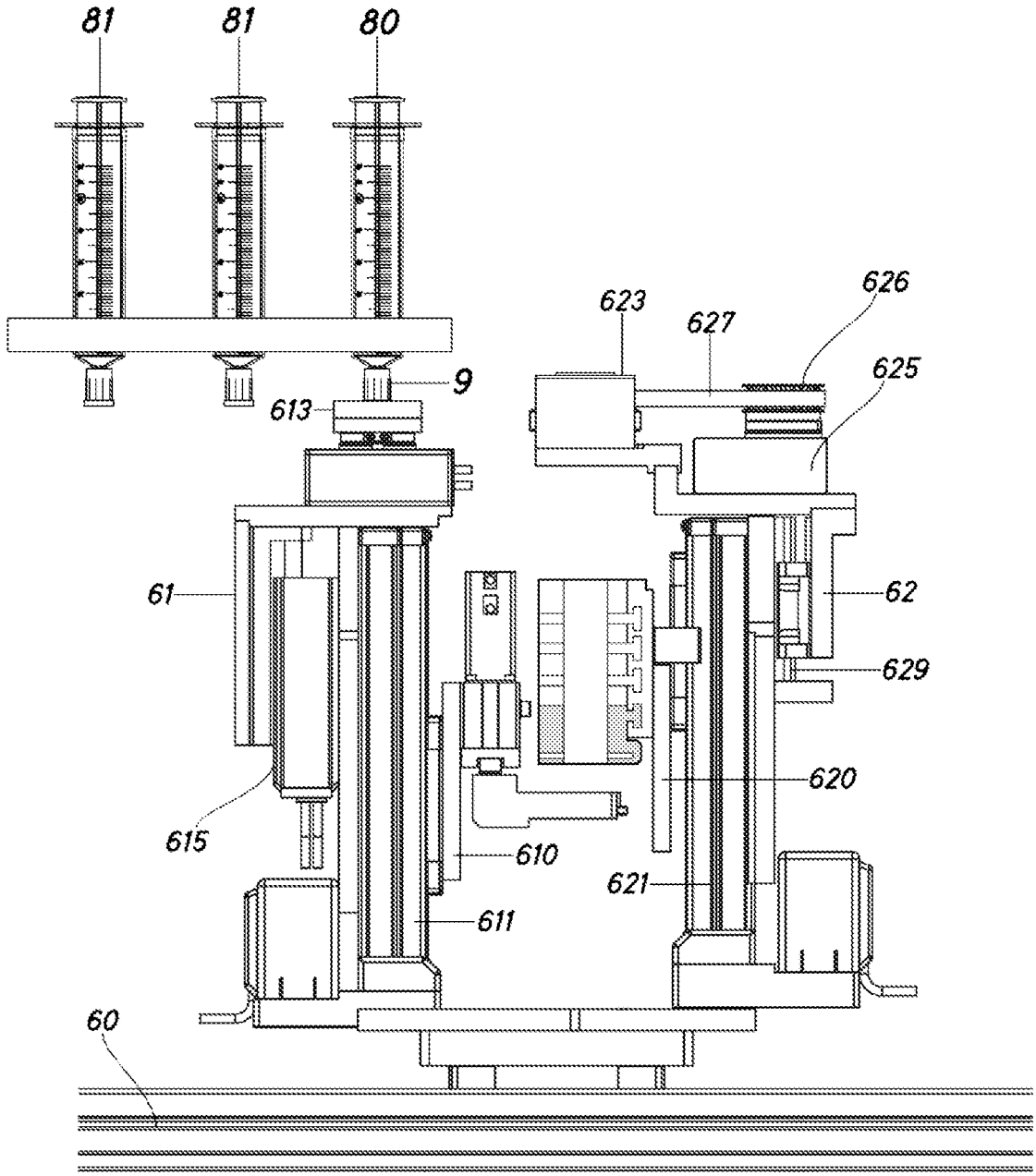
FIG. 10 is a view in side elevation of a first step of a method for removing and inserting substances in which the actuator, according to the second embodiment of FIG. 8, untwists the stopper of the initial container.
Figure 11:
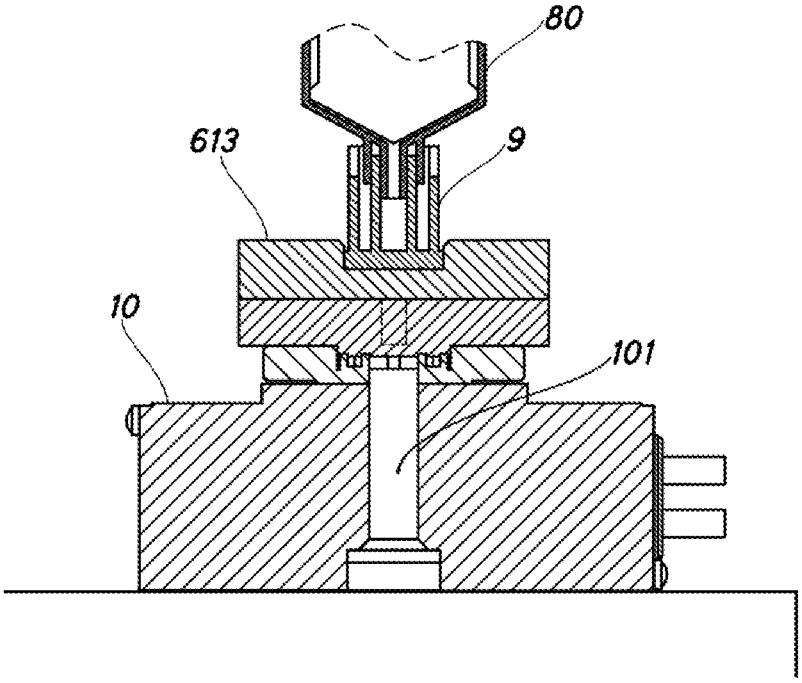
FIG. 11 is a detailed view in lateral cross section of the seating component of the actuator where the stopper to be untwisted is received, which component also comprises a vertical guide allowing the stopper to be rotated in order for it to be untwisted.

In FIG. 10, the actuator —6— is placed so as to position the seating component —613— of the actuator —61— beneath the stopper —9— of the initial container, in this case a syringe —80—. Next, said seating component —613— is moved closer to said stopper —9— with the aid of the vertical guide —615— so as to seat said stopper —9— in the receiving groove —614—. As illustrated in FIG. 11, a motor —10— having a central shaft —101— allows the seating component —613— to be rotated so as to untwist the stopper —9— from the nozzle of the syringe —80—.

Figure 12:
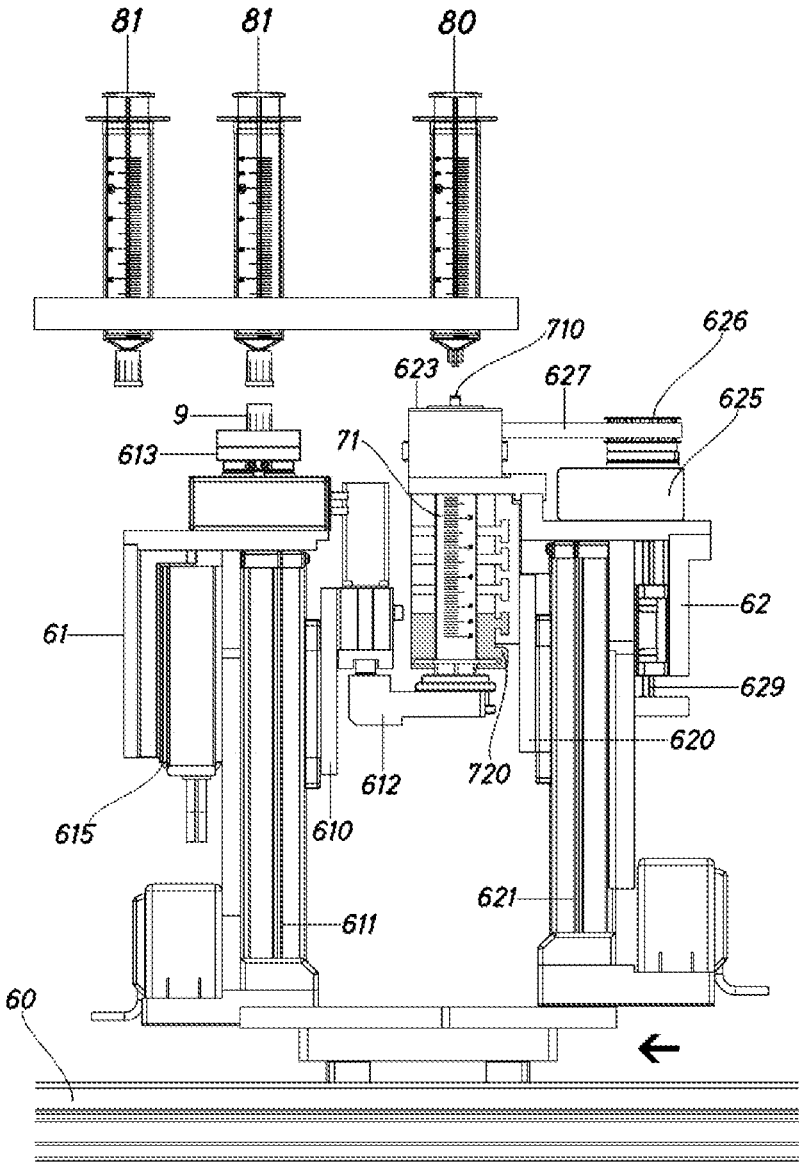
FIG. 12 is a view in side elevation of a subsequent step of a method for removing and inserting substances in which the actuator, according to the second embodiment of FIG. 8, has the removal syringe positioned vertically in line with the initial container.

Next, and as illustrated in FIG. 12, after untwisting the seating component has moved back vertically along the vertical guide —615— with the stopper seated in the receiving groove —614—. At the same time, the substance insertion and removal syringe —7—, which now includes their corresponding adaptors (—720—, —73—) for the syringe barrel and plunger flange, has been secured in the syringe barrel holder —620— causing the projection —721— to coincide with one of the grooves —622— in said holder —620—. In turn, the flange adaptor —73— is held, by means of its corresponding projection —731—, by the clamps —612— of the actuator —61—.

Figure 13:
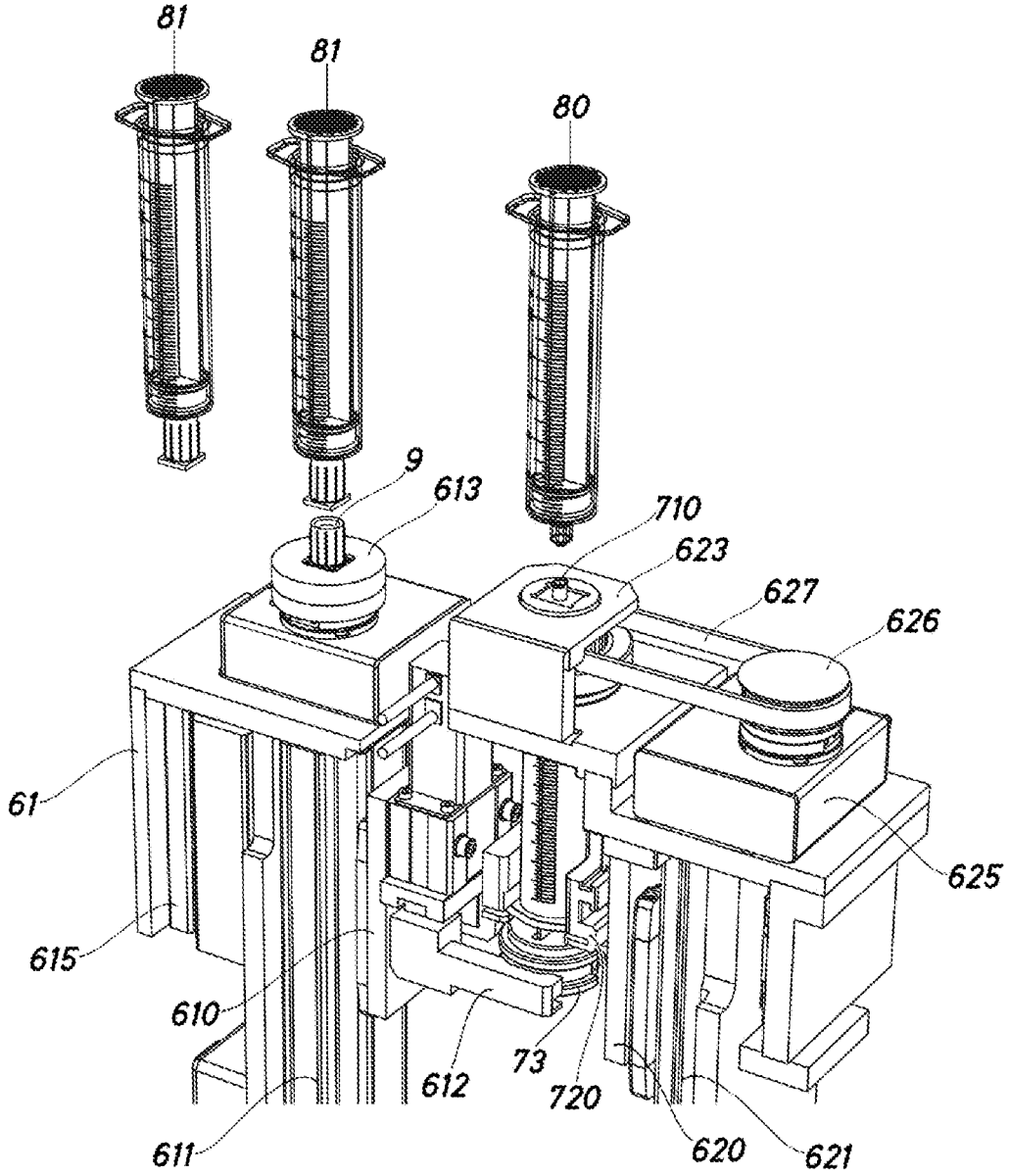
FIG. 13 is a detailed perspective view of the method step shown in FIG. 12 in which the different elements of the actuator that are involved in that step can be seen.

Next, the actuator —6— is moved horizontally to the left of its horizontal guide —60— so as to position the rotation actuator —623— of the actuator —62— beneath the initial syringe —80—. At the same time, the carriage —610— is moved vertically upwards, along the vertical guide —611—, in order to insert the distal zone of the syringe —7— having its corresponding adaptor —710— through the through-hole —624—, such that the adaptor —710— is facing the nozzle of the syringe —80—, as can be seen in FIG. 13.

Figure 14:
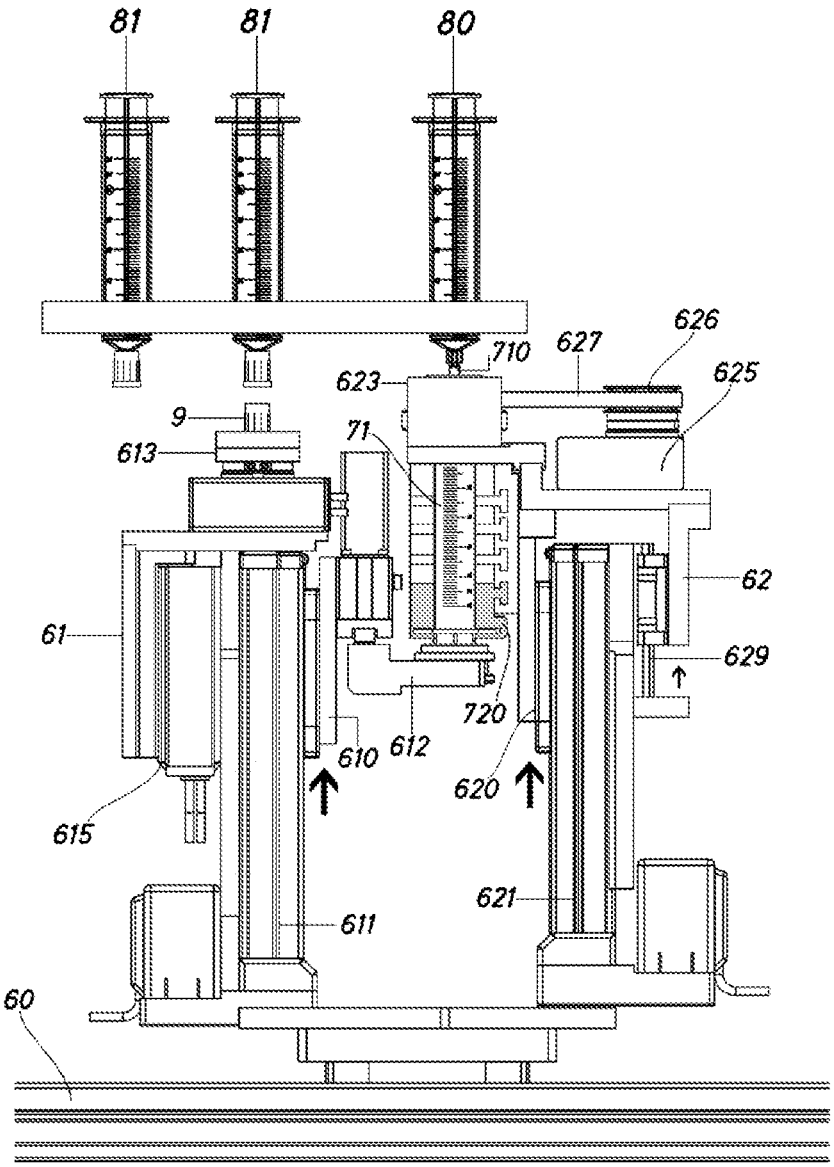
FIG. 14 is a view in side elevation of a subsequent step of a method for removing and inserting substances in which the actuator, according to the second embodiment of FIG. 8, is positioned so to connect the removal syringe to the initial container by a twisting process.
Figure 15:
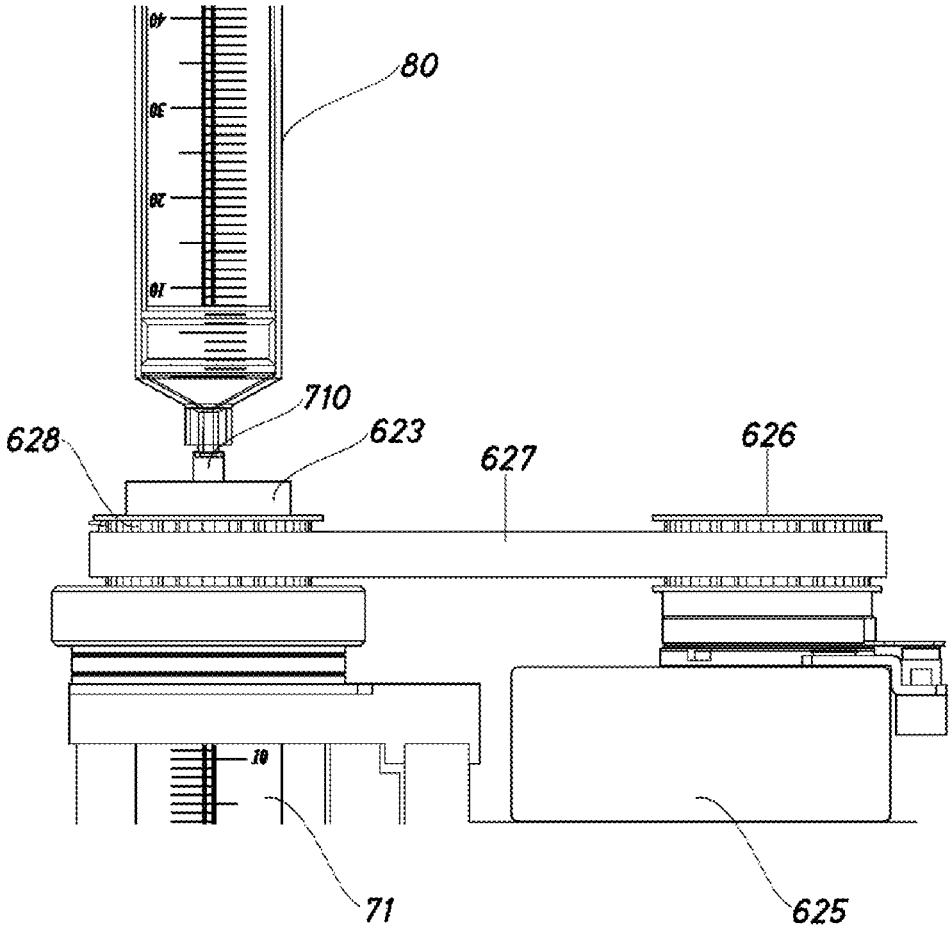
FIG. 15 is a detailed view in side elevation of the method step shown in FIG. 14 in which the different elements of the actuator that are involved in that step can be seen.
Figure 16:
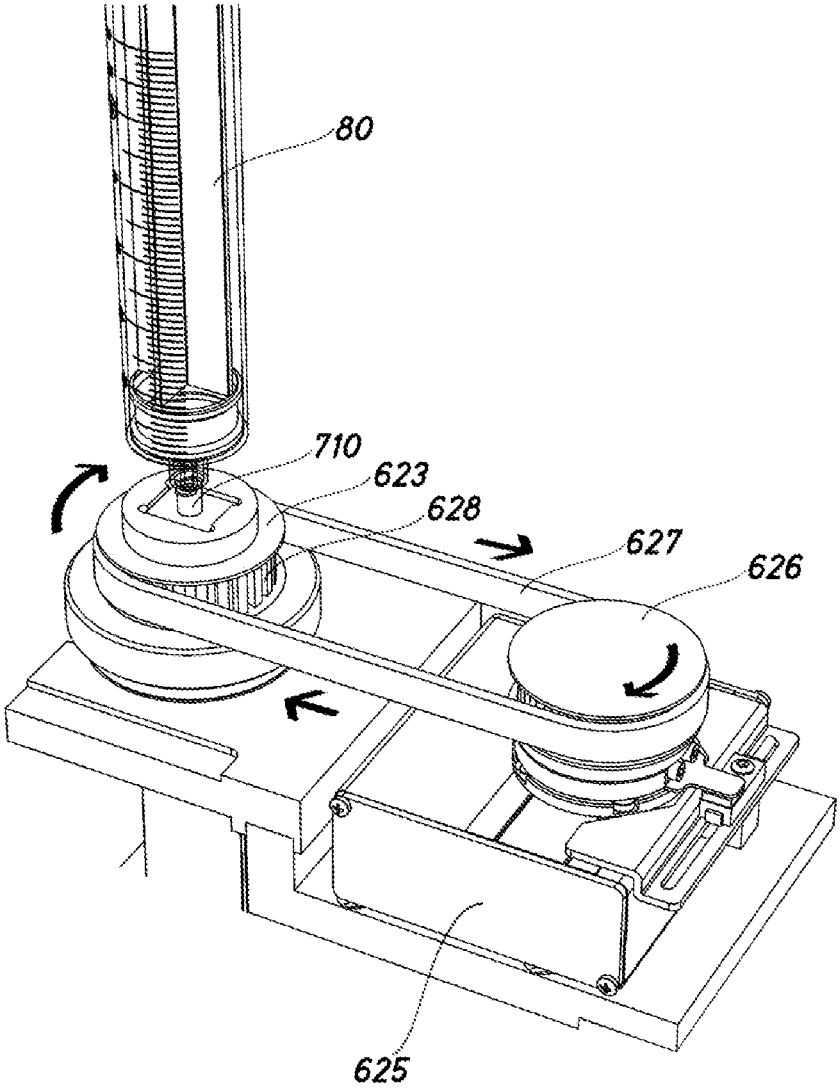
FIG. 16 is a detailed perspective view of the same method step shown in FIGS. 14 and 15.

As illustrated in FIGS. 14 and 15, the rotation actuator —623— together with the assembly (syringe —7—, adaptor —710—) is moved vertically upwards by the combined action of the respective vertical guides (—610—, —621—, —629—). At the same time and as illustrated in FIG. 16, the motor —625— is actuated, thereby rotating the guide —626□which, in turn and by means of the belt —627—, rotates the guide —628— of the rotation actuator —623—, resulting in the adaptor —710— being twisted and connected to the nozzle of the syringe —80—.

Figure 17:
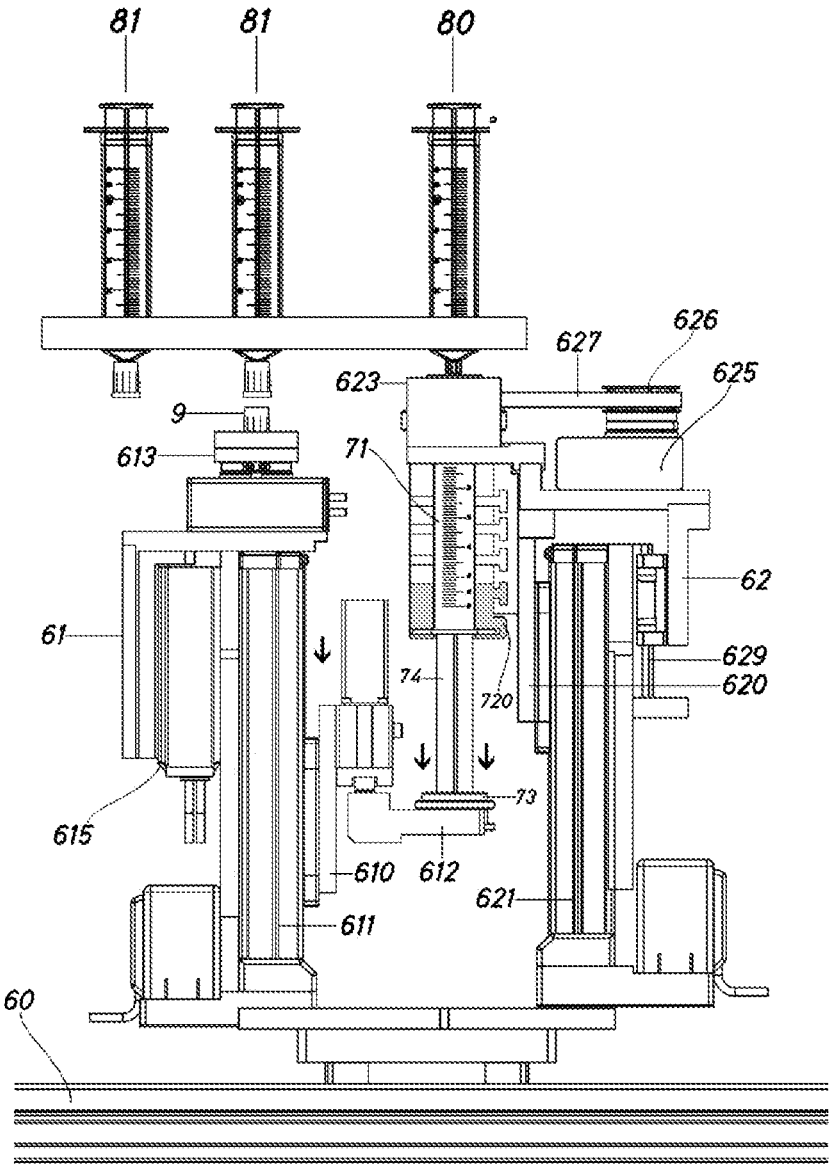
FIG. 17 is a view in side elevation of a subsequent step of a method for removing and inserting substances in which the actuator, according to the second embodiment of FIG. 8, acts on the plunger to remove the corresponding substance from the initial container.

Finally, and as illustrated in FIG. 17, the carriage —610— is moved vertically downwards along the guide —611— causing the plunger —74— to slide, by means of the clamps —612— which hold the plunger flange adaptor —73—, outside the barrel —71— of the syringe —7— so as to remove the substance from inside the syringe —80— into the barrel —71— of the syringe —7—.

Next, the actuator —6— is moved along its respective horizontal guide —60—, so as to position the seating component —613— of the actuator —61—, comprising the respective stopper —9— of the syringe —80—, exactly beneath said syringe —80—. Next, said seating component —613— is moved closer to said syringe —80— with the aid of the vertical guide —615— so as to insert the stopper —9— into the nozzle of the barrel of the syringe —80—. Next, the motor —10— having a central shaft —101— rotates the seating component —613— in the opposite direction so as to twist the stopper —9— into the nozzle of the syringe —80—.

The actuator —6— is then be able to insert the substance contained inside the syringe —7— into any final container —81— using an analogous and similar process to that explained earlier by making use of the actuators —61— and —62—.

Each actuator —6— according to this second embodiment can carry out the operations described with reference to FIG. 10 to 17 as many times as necessary depending on the requirements at the time.

In addition, the actuators —6— may have the same elements included in the actuators (—331—, —332, —333—) of the first embodiment.

Traceability Zone

As mentioned earlier, the traceability zone is distributed between the modules (—2—, —3—) of the machine —1— according to the present invention with the following peripherals:

(i) Peripherals of the Module —2—

Touch screen —21—: an information screen with access to prescriptions in order to load material appropriately and monitor the automatic filling process;

Printer —22—: for double-labelling the final products, before and after preparation, and the flasks. An example of a printer could be the Zebra series GK420D printer, among others.

RFID code reader, such as the Omron V680 system, for example. The label of the final product can be printed on reading the RFID of the adaptor of the final container, so as to place the label on the appropriate final container.

Emergency push button: Stops the machine in an emergency.

(ii) Peripherals of the Module —3—

Scales —31—: for weighing each product before and after preparation. It is used to ensure the accuracy and precision of the metering process. An example set of scales could be the Metler Toledo ref. MI3002/01 scales, among others. These scales have a tray, used to weigh infusion bags effectively.

Dataman 200S bar code reader.

RFID code reader such as the Omron V680 system, for example.

Enabling switch: used to start automatic preparation once the initial and final containers have been correctly loaded.

Display (not shown): allows step-by-step monitoring of what is being carried out.

Emergency stop button: Stops the machine in an emergency.

In general, when initial and final containers are loaded on the tray —4—, the following steps may be followed for each loading of the initial or final container:

place the container in its corresponding adaptor;

read the bar code on the container.

If it is an infusion bag or syringe, weigh said bag or syringe;

read the RFID of the adaptor;

a green light (LED) will be illuminated in the position of the tray —4— where the respective container should be placed (the LEDs are not shown in the figures);

place the respective container in the tray —4— and confirm;

previously illuminated light switched off.

For unloading, the opposite process will be followed.

If any of the initial containers is a flask, they will not be weighed. The programmable logic controller (PLC) of the machine —1— will check the quantity of medicine remaining in the flask, as it already knows the quantity held in the flask initially and the number and volume of the removals carried out. The RFID of the flask adaptor will be read and the corresponding adhesive label applied.

For unloading the final containers, said containers will be weighed, the RFID of the adaptor will be read and said containers re-labelled. Accuracy is thus ensured. When a reconstitution process takes place, the flasks will be the final container, and like all the final products, will be weighed.

Although the invention has been described in relation to preferred embodiments, said embodiments should not be considered to limit the invention, which will be defined by the widest interpretation of the following claims.

What is claimed is:

1. A machine for the automatic preparation of substances for intravenous application comprising:

a container receiving zone which defines a two-dimensional matrix of individual positions for initial and final containers arranged on a plurality of metering lines;

a plurality of actuators for transferring substances from initial container to final container, each of said actuators being positioned beneath said zone for receiving initial and final containers, each of said actuators being able to move relatively, independently of each other, along a horizontal guide parallel to one of said plurality of metering lines of said matrix, each of said actuators being configured to receive and operate injectors with different volumes and degrees of precision in order to remove substances from initial containers and insert them into final containers, wherein each injector comprises an adaptor arranged on an inlet/outlet port for direct connection to/disconnection from respective initial/final containers.

2. The machine according to claim 1, wherein each of the actuators for transferring substances can move vertically and horizontally independently of the rest of the actuators.

3. The machine according to claim 1, wherein the actuators comprise rotation actuators for twisting and untwisting any stoppers arranged in the inlet/outlet ports for substances of the respective containers and rotation actuators for connecting and disconnecting the inlet/outlet ports of the injectors to/from the inlet/outlet ports of the respective containers.

4. The machine according to claim 1, wherein the actuators comprise holding actuators for holding and operating plungers of said actuators.

5. The machine according to claim 1 further comprising automatic actuators for removing, holding and inserting injector caps.

6. The machine according to claim 1, wherein said injectors consist of syringes having a piercing point.

7. The machine according to claim 1, wherein said injectors consist of syringes having no piercing point.

8. The machine according to claim 1, wherein the adaptor is a Luer-Lock adaptor.

* * * * *